US005293649A

United States Patent [19]

Corpus

[11] Patent Number: 5,293,649

[45] Date of Patent: Mar. 15, 1994

[54] SIDE ATTACHMENT STRAP FOR HELMET

[76] Inventor: Thomas A. Corpus, 104 N. Oak St., Apt. #6, Greenville, N.C. 27858

[21] Appl. No.: 786,093

[22] Filed: Oct. 31, 1991

[51] Int. Cl.[5] ..... A41D 13/00; A42B 3/00

[52] U.S. Cl. ..... 2/424; 2/9

[58] Field of Search ..... 2/424, 9, 425, 10; 24/458, 563

[56] References Cited

U.S. PATENT DOCUMENTS

| | | | |
|---|---|---|---|
| 4,086,664 | 5/1978 | Humphrey | 2/424 |
| 4,233,687 | 11/1980 | Lancellotti | 2/9 |
| 4,633,531 | 1/1987 | Nimmons | 2/9 X |
| 4,837,866 | 6/1989 | Rector et al. | 2/424 |
| 4,933,993 | 6/1990 | McClelland | 2/9 X |
| 4,985,938 | 1/1991 | Snow, Jr. | 2/424 |
| 5,095,552 | 3/1992 | Parkinson | 2/9 X |

*Primary Examiner*—Peter Nerbun

[57] ABSTRACT

In prior art face guard mounting technology, the guard is attached to the helmet by four attachment straps. This invention pertains to improving the way that the guard is mounted to only the sides of the helmet. Each prior art side attachment strap is in the form of a single loop that encircles the rear most bar of the guard. The prior art design holds the guard to the helmet restricting the guard from moving only in the direction that the side attachment strap points in. However, the prior art side attachment has no means of restricting the guard from moving down through the loop in the side attachment strap, nor does it keep the guard from rattling, tilting or moving up and down on the helmet. The present invention side attachment strap provides a means of restricting the guard from getting moved around on the helmet. The improved side attachment strap eliminates the problems encountered by the prior art design by containing two loops, with a 90 degree angle between the loops. The first loop encircles the rear most vertical bar of the guard, restricting the guard from moving in the fore and aft directions, while the second loop encircles the lowest horizontal bar, of the rear section of the guard, restricting the guard from moving in the vertical direction. The invention when mounted on the helmet, takes the form of the letter "L" rotated about the X axis 180 degrees and rotated about the Y axis 90 degrees.

12 Claims, 13 Drawing Sheets

PRIOR ART

PRIOR ART

SIDE ATTACHMENT STRAP FOR HELMET

BACKGROUND OF THE INVENTION

The present invention pertains to securing a face guard to a football helmet so that the guard is restricted from moving in all directions.

A football helmet is a plastic shell that protects ones head while playing the game of football. This shell, however, leaves the face unprotected. Thus, a grid-like series of plastic coated metal bars is attached to the helmet on the top and on the sides to protect the face. However, the face guard can also be constructed of just plastic segments. Football is a collision sport and this system of the helmet, face guard and attachments must withstand all blows encountered by the player and distribute and redirect these forces away from the player's face and head.

Two prior art patents which disclose mounting systems for mounting a face guard to a football helmet are U.S. Pat. Nos. 4,086,664 and 4,633,531, herein incorporated by reference. In both of these face guard mounting systems are disclosed wherein the side attachment straps provide no means of restricting the face guard from moving through the loops of the prior art side attachment straps upon contact. The direction of this movement is perpendicular to the direction that the prior art side attachment straps are pointing in. U.S. Pat. No. 4,086,664 has its side attachments mounted in compression and U.S. Pat. No. 4,633,531 has its side attachment straps mounted in tension; however, it turns out that this problem of movement through the loops is not restricted to one attachment method, tension or compression, but rather a problem in that neither method restricts the movement in all directions.

In prior art face guard mounting assemblies, the face guard is considered to be hinged, about a horizontal axis, by the two front attachments. This allows, if the side attachments were not in place, for the guard to be swung in an arc pattern on the helmet in the fore and aft directions. Thus, if the side attachments were not in place and the face guard was pushed back from its designated position on the helmet, it would swing angularly upward toward the rear of the helmet in an arc pattern. The face guard is attached to the helmet by two front attachments and by a single attachment on each side of the helmet.

Background information is also needed on where the prior art side attachment strap is placed and in what direction it restricts the face guard from moving. The face guard has a rear portion that extends over the ear flaps of the helmet shell. This rear portion is comprised of a lower and an upper bar, that bend angularly upward towards the rear of the helmet, these bars project from the main frame of the face guard. The lower of these two horizontal bars has a bar stemming from it, at approximately a 90 degree angle, forming an "L" shape, that is upwardly inclined toward the top of the face guard. This upwardly inclined bar connects to the upper horizontal bar and then connects to the top of the face guard; thus, completing the rear portion of the face guard. These two horizontal bars and the upwardly inclined bar, that connects the two, form the rear portion of the face guard that gets secured to the helmet. The 90 degree angle, although it could conceivably vary between approximately 65 and 115 degrees, referred to above, is a constant on all of the face guards that the leading manufacturer, Schutt, produces. The improved side attachment strap utilizes the consistency of this angle, enabling it to be used on all of these face guards. However, the lower angle that is formed between the top-most horizontal bar and the upwardly inclined bar, of the rear section of the guard, does not remain constant on each of the fifty-one different face guards that Schutt manufactures.

The designed placement of the prior art side attachment strap is as close as possible to the lowest of the two horizontal bars that comprise the rear portion of the guard. The horizontal bars are slightly angularly inclined upwardly toward the rear of the helmet, and the prior art side attachment straps should follow this inclined path toward the rear of the helmet. The prior art side attachment straps were designed to Sit as close as possible to the lower of the two horizontal bars of the rear section of the guard; this is because the top front two attachments act as a hinge for the face guard. Thus, it is better when the prior art side attachment strap is lower because there is a longer moment arm to absorb the impact.

The two prior art side attachment straps secure each rear portion of the guard to the helmet. Each prior art side attachment strap consists of a single loop that encircles the vertically inclined bar of the rear portion of the guard. Therefore, each prior art side attachment strap restricts the guard from moving only along the arc pattern that is set up as a result of the guard being hinged at the top of the helmet by the front two attachments.

However, the prior art side attachment strap has no means of restricting the upwardly inclined bar of the rear portion of the guard from being moved down, upon contact, through the single loop of the prior art side attachment strap. The bar moving down through the side attachment loop could be looked at on some helmet systems, as a tilting phenomenon. Since the guard is attached by the two front attachments at the top of the helmet, both sides of the face guard cannot get moved down; however, one side of the guard can slide down through the loop upon contact approximately one inch. Thus, the guard appears to be slightly tilted on the helmet. This movement is both a safety problem and an enormous inconvenience to the player. A major safety problem is that unexpected stresses could be set up in the helmet, face guard or in the prior art side attachment straps that could cause any or all of them to fail. When one rear portion of the guard moves down approximately one inch, the chin strap buckle gets covered over, which does not allow the chin strap buckle to be disengaged from the chin strap snap until the equipment manager loosens the prior art side attachment straps and readjusts the face guard on the helmet. This is very inconvenient to the player and the equipment manager; because, when one's chin strap moves from the original place that it was adjusted to, which often occurs, the player cannot readjust the chin strap himself. A safety problem hazard is if the chin strap had to be removed from the player in an emergency, the process would be delayed because of this movement. Also, the prior art side attachment strap allows the guard to shake and rattle around during the course of play, which is very distracting to a player during game situations.

SUMMARY OF THE INVENTION

The present invention overcomes the disadvantages of the prior art side attachment straps described above by providing an improved mounting system that more securely attaches the face guard to the helmet.

The most rear portion of the face guard is the section of the guard that gets attached to the helmet. The basic outline of the rear portion of the face guard is in the form of an "L." The prior art side attachment strap only encircles the vertical bar of this "L."

This invention has two loops, one loop for each section of the "L" shaped rear portion of the face guard. Each loop will restrict movement perpendicular to the direction that the loop aperture points in; hence, completely restricting the guard from movement to a significant degree in ay direction. Each loop of the present invention side attachment strap is mounted so that when the face guard encounters a frontal blow the loops of the attachment are put in tension. To enable the side attachment straps to absorb most of the shock they should be made of a resilient material and fashioned in such a manner that they offer the proper stiffness and flexibility to achieve this task. A material that meets these needs is a polycarbonate/polyeruethaiie resin; however, this is only one of many materials that are available.

This improved "L" side attachment strap will solve the problems that the prior art side attachment straps encountered. The improved side attachment strap not only solves the prior art's problems but has the additional advantage of universally fitting on at least all of the leading manufacturers' guards.

Another advantage of the improved side attachment strap is that no new mounting holes will need to be drilled. The present invention can be secured in the same location as the prior art side attachment straps.

The improved side attachment is a strap composed of two loops with a 90 degree angle between them. The two loops combine at the head portion of the side attachment strap, this is the central part of the side attachment strap where the screw is placed to hold it to the helmet. The loops of the improved side attachment are not closed flush until they are screwed closed while holding the guard to the helmet.

Thus, the improved side attachment strap is the only practical solution to the problems that the prior art side attachment straps encountered. This invention can be used for other sports, such as hockey or baseball.

BRIEF DESCRIPTION OF THE DRAWINGS

The above-mentioned invention along with other features and objects of the invention and manner of attaining them will become more apparent and better understood in view of the following figures:

FIG. 4 shows where the face guard, held in place by the prior art side attachment straps, frequently gets moved to.

DETAILED DESCRIPTION OF THE DRAWINGS

Figure 9:
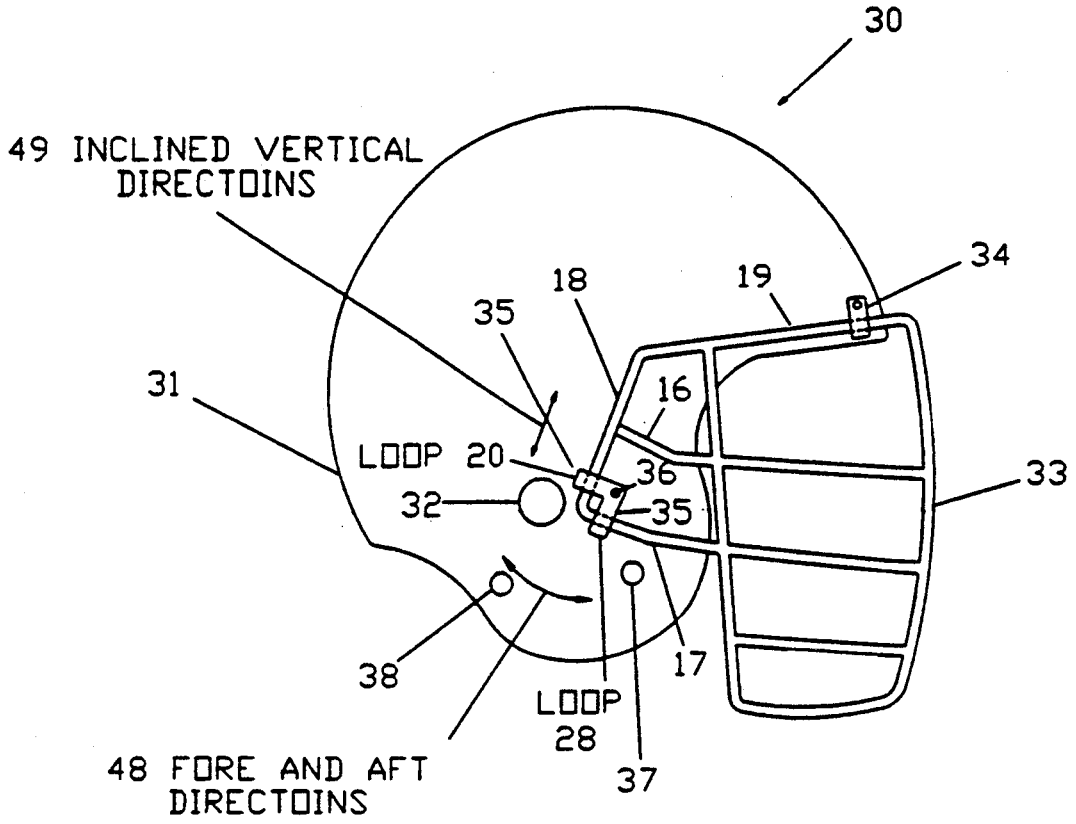
FIG. 9 is a perspective view showing the improved "L" side attachment strap mounted to the helmet, totally securing a single wire face guard to the helmet.
Figure 10:
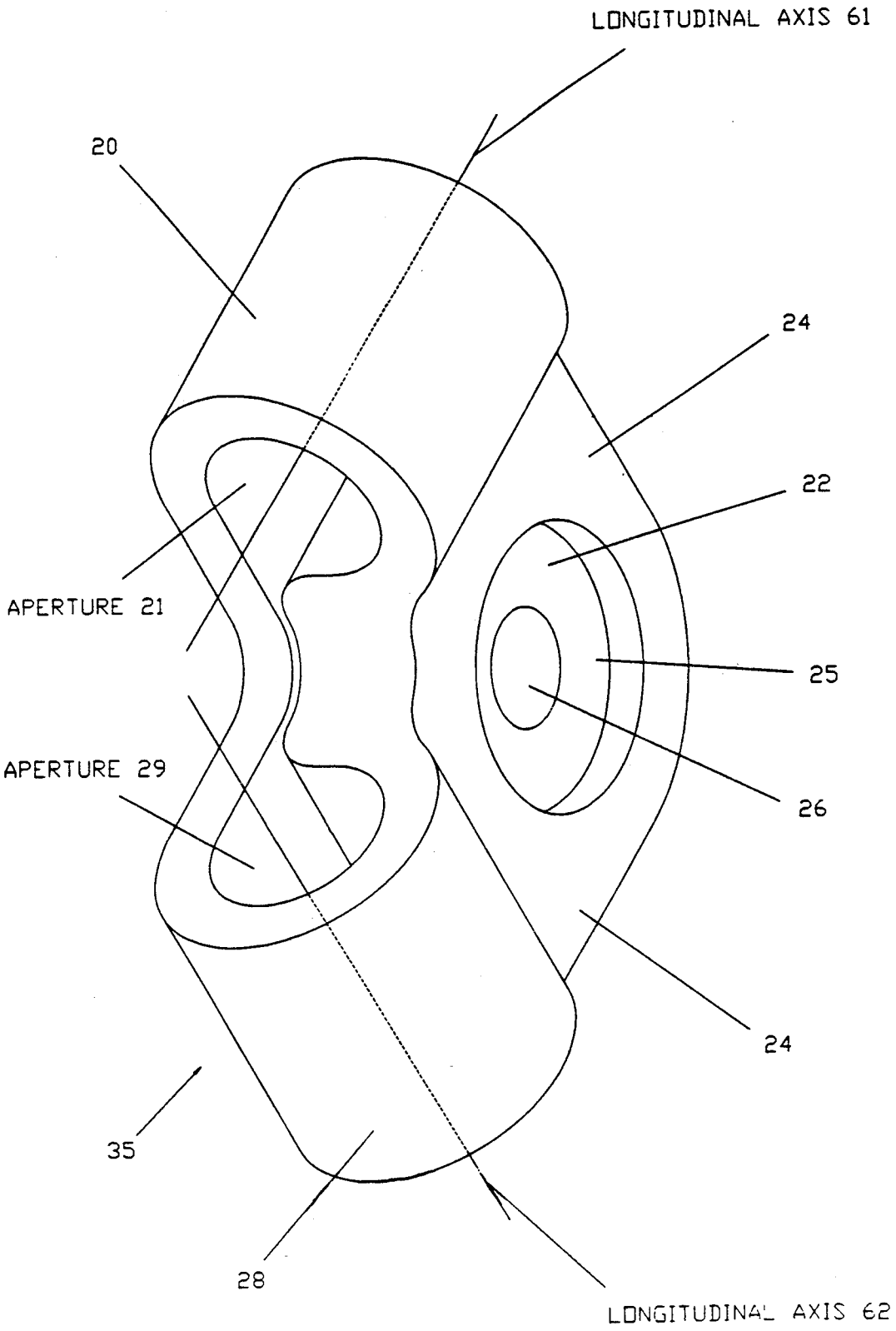
FIG. 10 is an isometric view of the present invention improved "L" side attachment strap.
Figure 11:
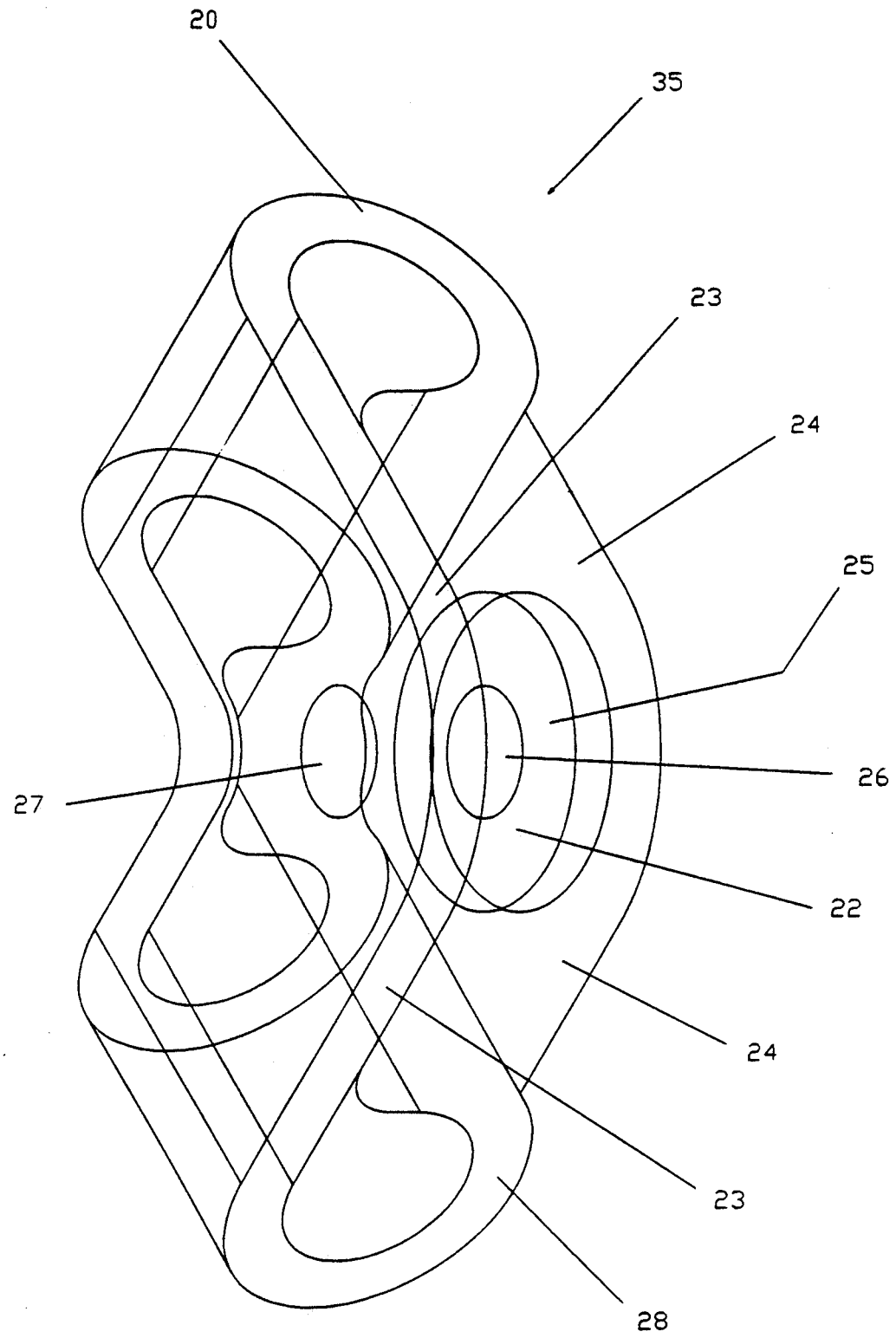
FIG. 11 is an isometric evaluational view of the present invention improved "L" side attachment strap showing its "hidden lines."

A football helmet system 30 is referred to in FIG. 9. The helmet system includes the helmet 31, ear holes 32, face guard 33, front attachments 34 (as described in U.S. Pat. No. 4,633,531), present invention "L" side attachments 35, fasteners 36, topmost chin strap snap 37 and bottom most chin strap snap 38. Ref erring to FIGS. 5 and 6, the section of the face guard enclosed by dotted region 15 will be referred to as the rear section of the guard. This rear section is the part of the face guard that gets attached to the side of the helmet.

Figure 5:
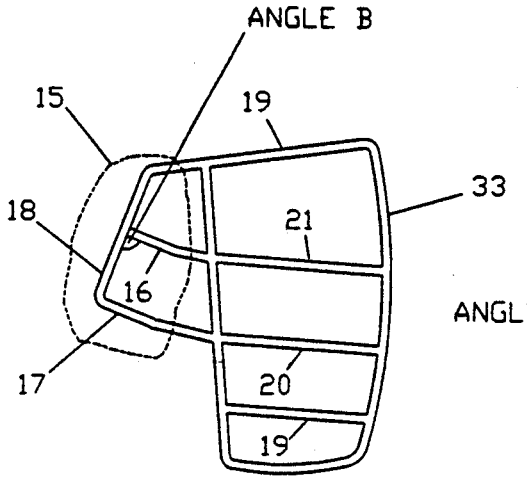
FIG. 5 shows a side view of a full cage single wire face guard, with the rear portion of the guard highlighted.

Referring now to FIG. 5 the rear section of the face guard is disclosed by dotted region 15. This rear section of the guard is comprised of two bars, 16 and 17, that start out traveling horizontally then bend angularly upward toward the rear of the helmet, these bars project from the main grid of the face guard 33. In FIG. 5, segment 16 refers to the upper of these two bars while segment 17 refers to the lower of these two bars.

The lower of these two horizontal bars 17 has an upwardly inclined bar 18 stemming from it, at approximately a 90 degree angle. Bar 18 is upwardly inclined toward the main frame of the face guard 33. This upwardly inclined bar 18 connects to the topmost horizontal bar 16 of the rear section of the helmet then continues upward to connect to the topmost bar 19 of the main grid of the face guard 33.

Figure 1:
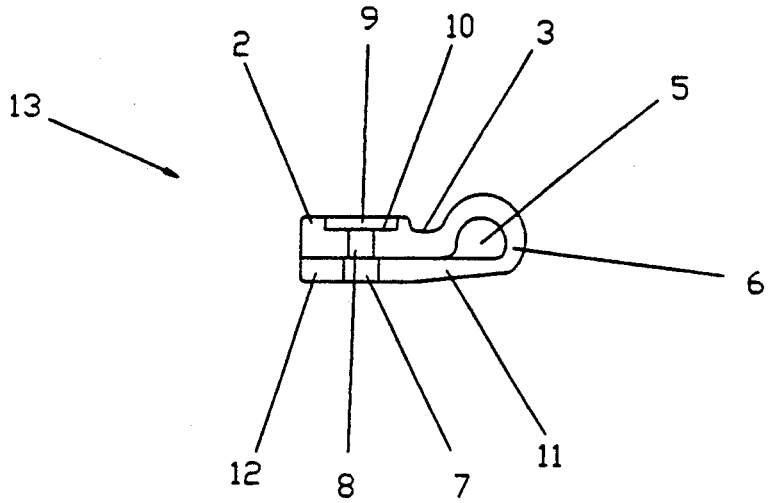
FIG. 1 PRIOR ART
FIG. 1 is a sectional evaluational view of the prior art side attachment strap.
Figure 2:
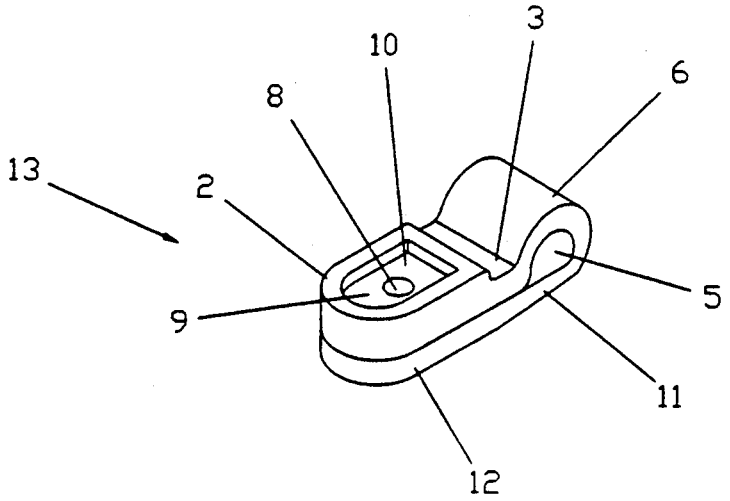
FIG. 2 is an isometric view of the prior art side attachment strap.

FIGS. 1 and 2 disclose the prior art side attachment strap 13. Prior are side attachment 13 is formed in the shape of a strap having a single loop portion 6. There is a first strap end portion 12 on prior art side attachment strap 13 and a second strap end portion 2; portion 2 is also referred to as the head section. There is also a neck portion 3 on prior art side attachment strap 13. Section 11 denotes the tapered section of the first strap end portion 12 which gives added flexibility. A recess 9 is provided in head section 2 to house the head of the fastener 36, that runs through apertures 7 and S. Aperture 8 is in head section 2, and aperture 7 is in the first strap end portion 12. Shoulder 10 of recess 9 is engaged by the head of fastener 36; aperture 7 is larger in diameter than aperture 8 because it houses the T-nut that fastener 36 screws into through aperture 8.

Figure 7:
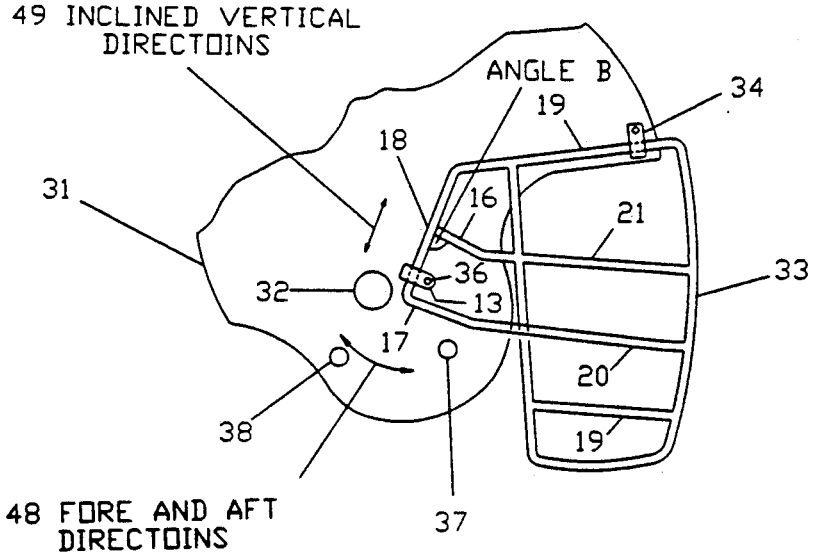
FIG. 7 PRIOR ART
FIG. 7 is a fragmentary view of a full cage single wire guard attached to the helmet by the prior art side attachment straps.

FIG. 7 is a fragmentary view of a helmet depicting a face guard 33 attached to the side of a helmet 31 by the prior art side attachment straps 13 and front attachment straps 34 in such a manner that the face guard is considered to be hinged by the front attachments 34 about the horizontal axis of bar 19. If the prior art side attachments 13 were not in place, the face guard 33 could be swung in an arc pattern in the fore and aft directions 48 about front attachments 34. The inclined vertical direction 49 is approximately in the direction of the lower part of bar 18 when bar 18 is mounted properly on the helmet as shown in FIG. 7.

Figure 3:
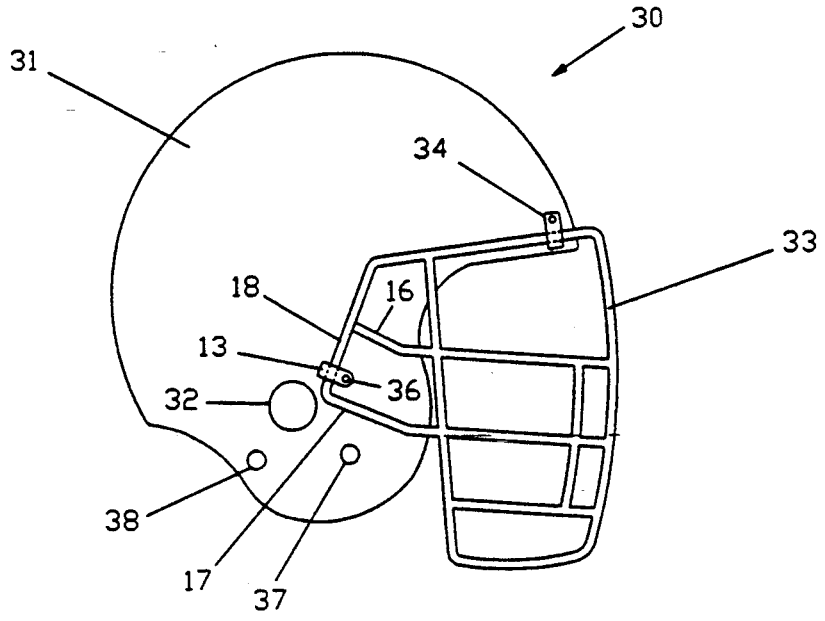
FIG. 3 PRIOR ART
FIG. 3 depicts where the prior art side attachment is originally positioned on the helmet and where it should stay.

FIG. 3 shows the location where the prior art side attachment strap 13 should begin. The prior art side attachment 13 should ideally be located as close to bar 17 of the guard as possible. This is because the face guard can be modeled, during a stress analysis, as if it is hinged at the top of the helmet by the 2 front attachment straps 34. Thus, by the prior art side attachment straps 13 being as close to the bottom bar 17 of the rear section 15 of the guard 33 as possible, the longest moment arm is set up to absorb the impacts of the collisions.

Figure 4:
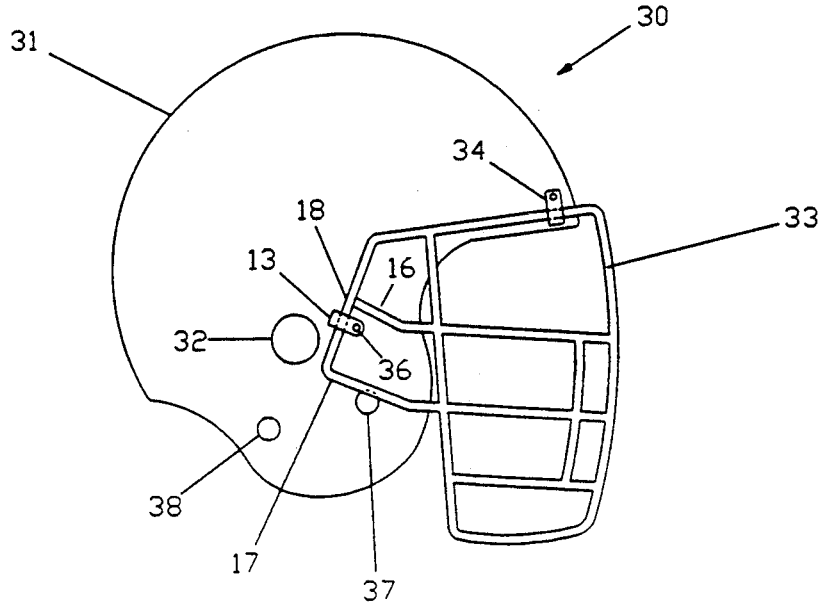

The problems encountered when using the prior art side attachment straps are a result of the fact that they have no means of restricting bar 18, of face guard 33, from being moved down through the loop in the prior art side attachment strap 13 due to contact. Note, that in FIG. 4 the prior art side attachment strap remains screwed in the same location that it was in FIG. 3. However, FIG. 4 shows the worst case scenario for one helmet system, where bar 18 of face guard 33 has been knocked down through the loop of the prior art side attachment strap 13 approximately one inch; bar 16 of guard 33 is now positioned next to the prior art side attachment strap 13 instead of bar 17 as it is designed to be. The face guard 33 actually remains in the four prior art attachment straps but is tilted in one direction. Note, that when the guard gets tilted down an inch to one side, it has moved so far that it is lodged there and cannot return to its original position or rattle around.

The biggest problem that is raised by the movement phenomenon described above is that the rear section 15 of the guard 33 covers over the chin strap buckle. When the chin strap buckle gets covered over it is impossible to remove that buckle of the chin strap from the chin strap snap on the helmet until the equipment manager loosens the two prior art side attachment straps and un-tilts the face guard; thus, uncovering the chin strap buckle. However, one side of the guard 33 does not always get tilted to a specific side. Rather, the face guard could rattle around upon each collision. That is, one side would not get tilted down permanently, and stuck there, but rather while running or on each collision, the guard could rattle up and down or continuously tilt from one side to the other, which is very annoying and distracting to the player.

Figure 8A:
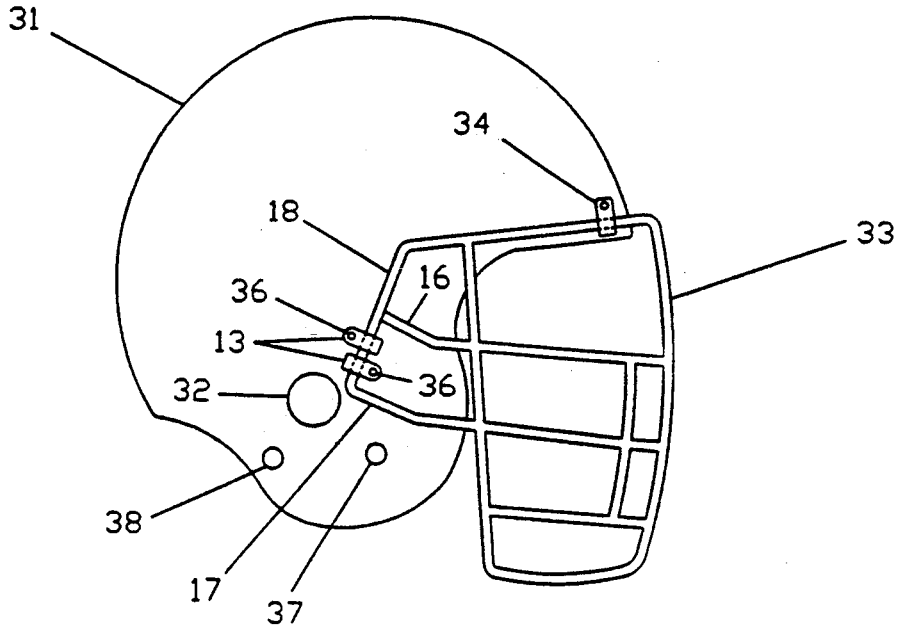
FIG. 8(a) PRIOR ART
FIGS. 8*a* and 8*b* show two methods of using two of the prior art side attachment straps in parallel, in a not so successful attempt at reducing the amount of movement of the face guard on the helmet.
Figure 8B:
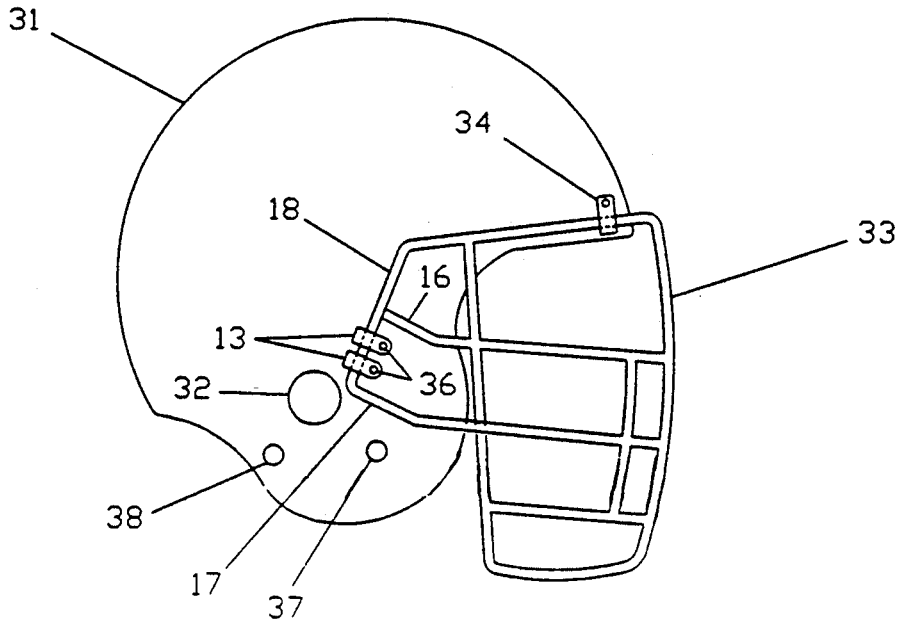
FIG. 8(b) PRIOR ART

FIGS. 8*a* and 8*b* depict two methods equipment managers in the NFL have used in an attempt to solve this movement problem. Note that they can fit two of the prior art side attachment straps inside the rear section 15 of guard 33. FIG. 8*a* depicts the first method, where one strap is placed in compression and the other is placed in tension. In the second method, FIG. 8*b*, both prior art side attachment straps are placed in tension. The jerry-rigging of the two prior art side attachment straps in parallel does eliminate some of the movement of bar 18 because the two straps essentially act as a block. However, this method does not solve all of the problems because there is still room for bar 18 of the rear section 15 of guard 33 to move a small amount. This is because the rear section 15 of the face guard 33 was not designed to snugly fit two of the prior art side attachment straps, thus, the equipment managers in the NFL, that the author of this patent has talked with, are not satisfied with the results they have obtained from using two of the prior art side attachment straps in parallel. There is still movement of bar 18 of the rear section 15 of guard 33; also, the face guard continues to rattle and move around. One other problem with this make-shift corrective method is that an extra hole that was not designed to be there, has to be drilled into the helmet to secure the second side attachment in.

Referring now to FIGS. 10–13 an "L" side attachment strap 35 according to the present invention is shown, including 2 loop sections 20 and 28 (the loop portions can include any shape as long as it is capable of wrapping around a bar or plastic segment), 2 loop apertures 21 and 29 with longitudinal axes 61 and 62 which run longitudinally through the apertures and run approximately through the center of the apertures, a first strap end portion 23 a second strap end portion 24 (or head portion), a recess 25 for housing the head of the fastener 36, the shoulder of the recess 22, an aperture 26 in strap end 24, and a slightly larger angled aperture 27 in strap end 23.

Figure 12:
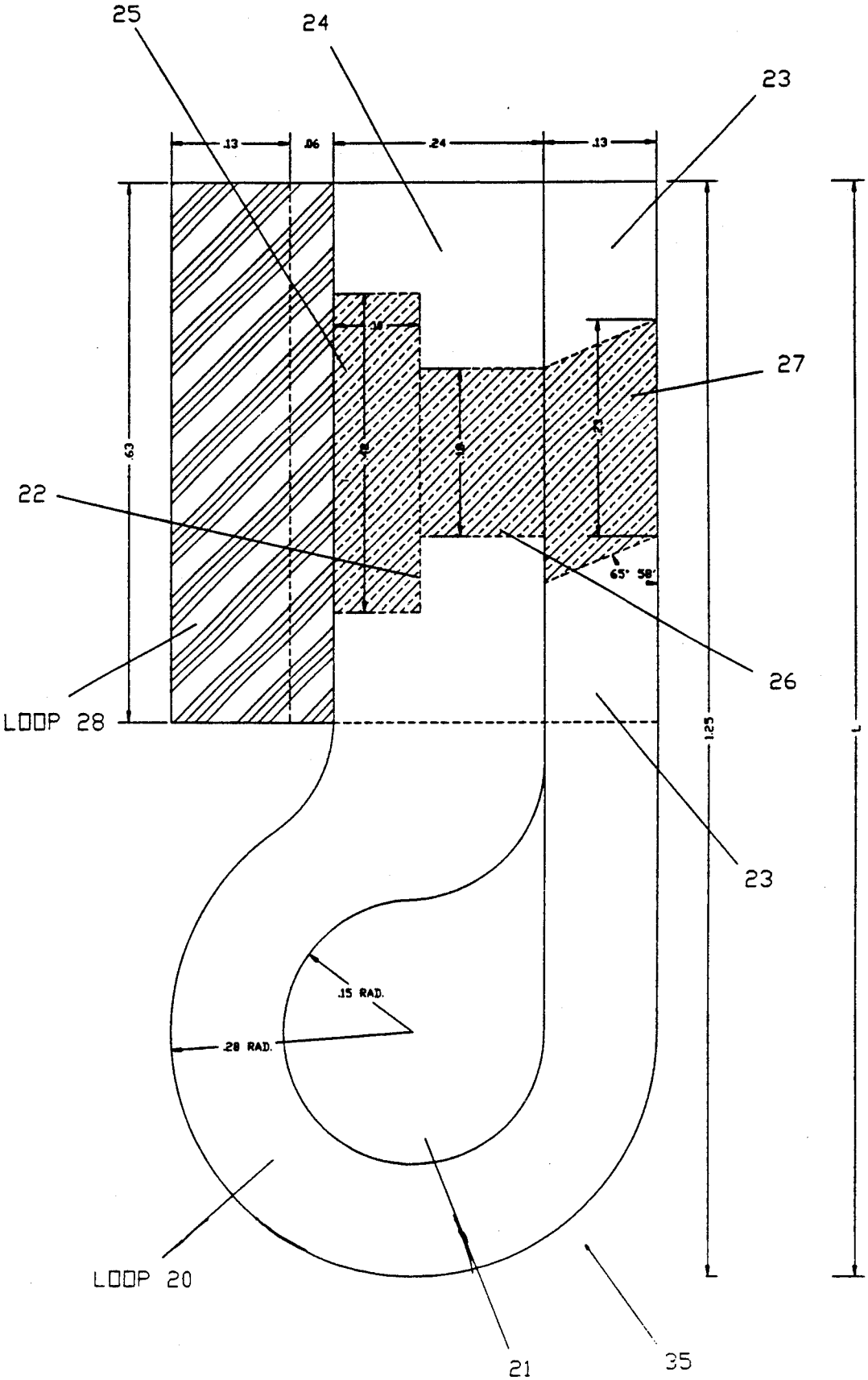
FIG. 12 is a sectional view of the present invention improved "L" side attachment strap taken at Section AA of FIG. 13.
Figure 13:
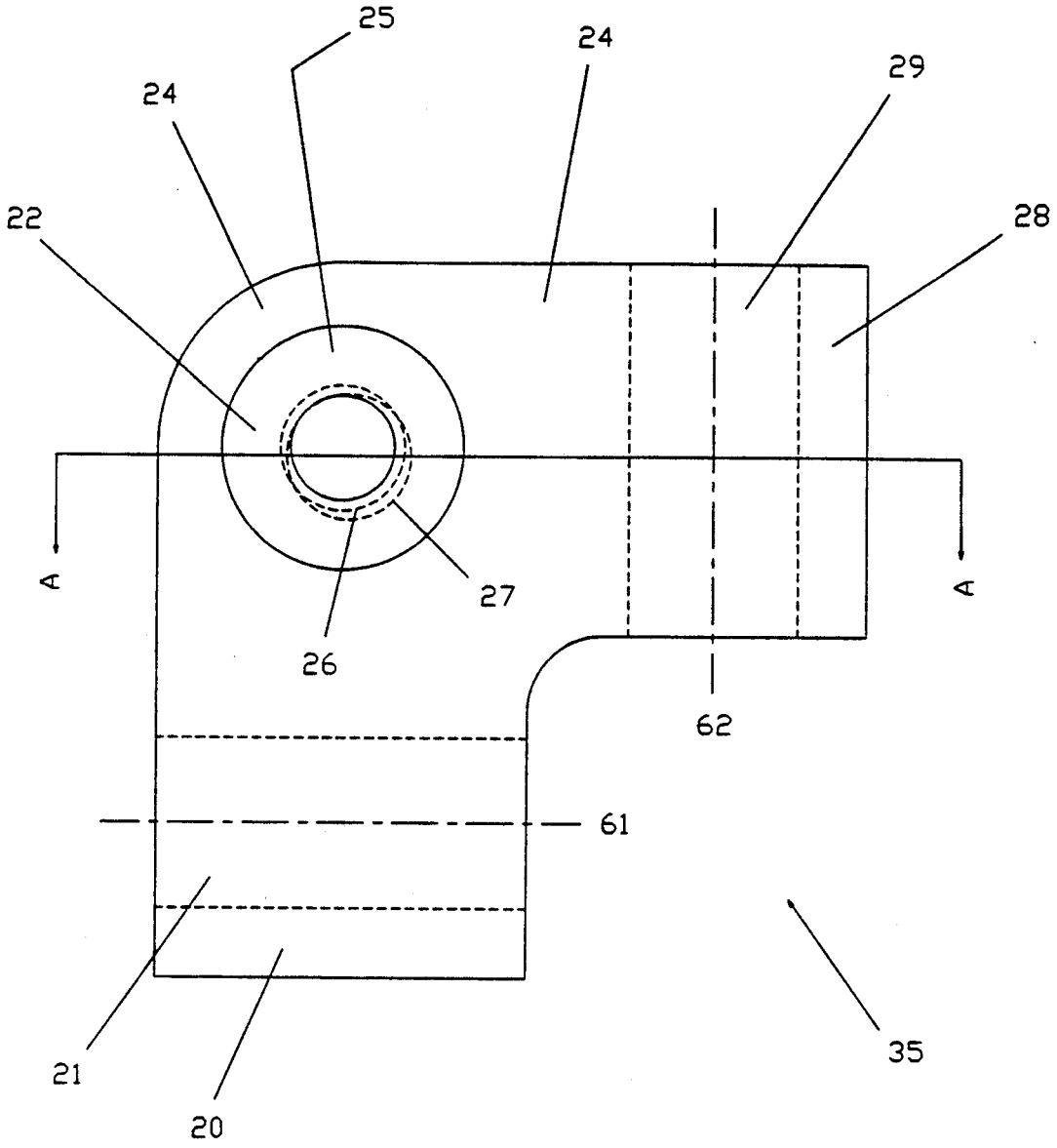
FIG. 13 is a plan view of the present invention "L" side attachment strap.

Referring to FIG. 13, a plan view of the "L" side attachment, it is evident that the preferred design of the present invention is that it is symmetric. FIG. 12 shows that each loop 20 and 28 is formed by the lower strap end portion 23 looping into the second strap end portion 24. Refer to FIG. 9 and note the elegance of the present invention "L" side attachment strap 35. Loop 20 of the side attachment strap 35 encircles bar 18 of the rear section 15 of guard 33 and prevents the mask from moving to a significant degree in the arc pattern 48 that is set up as a result of the guard being hinged at the top of the helmet by front attachments 34. The improvement of the "L" side attachment strap 35 over the prior art side attachment strap 13 is that stemming off of the head section, at a 90 degree angle, is loop 28 that encircles bar 17 of the rear section 15 of the guard 33. By loop 28 encircling bar 17, bar 18 of the rear section 15 of the guard 33 is restricted from getting moved to a significant degree in the inclined vertical direction 49 through loop 20. The improvement of this invention consists in simultaneously positively restricting movement in the inclined vertical direction- i.e. friction plays a negligible role in preventing movement in the inclined vertical direction. Thus, solving and eliminating the above-stated problems of the prior art side attachment strap 13. Referring to FIG. 9, note that each loop of the present invention side attachment strap 35 will be put in tension when the guard encounters a frontal blow. By securing the sides of a face guard 33 to a helmet 31 with the present invention "L" side attachment straps 35 the user of a helmet would have a face guard 33 that is totally secured to his helmet and not have to worry about bar 17 of the rear section 15 of guard 33 moving down over the chin strap buckle or guard 33 rattling or moving around during play.

Figure 6:
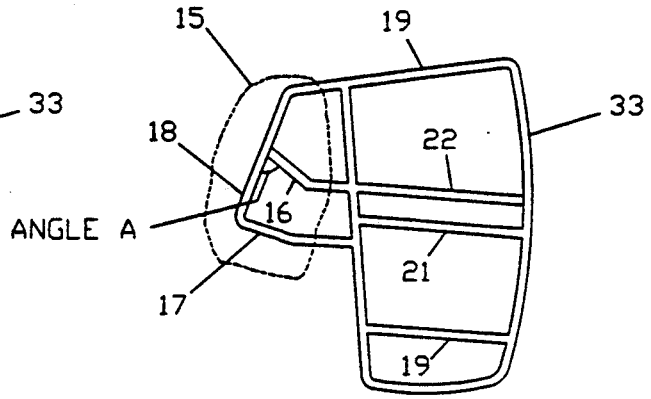
FIG. 6 shows a side view of a full cage double wire face guard, with the rear portion of the guard highlighted.

For all of the different types of guards, the rear section 15 will take one of two forms; bar 16 will bend and join added bar 22 in the main grid of the face guard as in the double wire guard in FIG. 6 or bar 16 will not bend and join the existing bar 21 in the main grid of the guard as shown in the single wire guard in FIG. 5. Note that bar 16 of the rear section 15 of the guard 33 leaves bar 18 at a particular angle, B, for the single wire guard and at a different angle, A, for the double wire guard. Notice that bar 22 is not present in the single wire guard, only in the double wire guard. However, the angle between bars 17 and 18 of the rear section 15 of the guard 33 remains constant at approximately 90 degrees for both the single wire and double wire guards.

The "L" side attachment can be symmetrical; that is, it has the same dimensions in the horizontal direction, loop 20, and the vertical direction, loop 28. The fact that the present invention "L" side attachment strap is symmetric permits one design of the present invention "L" side attachment strap to fit on either side of any of the face guards produced by the leading manufacturers; a universal design that solves the problem of the prior art side attachment straps.

FIG. 12 is a cross-section of FIG. 13 taken at line AA. The inner radius of the loop apertures can range from 1.00 to 0.05 inches and the outer radius of the loop apertures can vary between 1.15 and 0.15 inches respectively and the total length L of the "L" side attachment strap can vary between 0.5 and 2.0 inches. The preferred dimensions of the present invention "L" side attachment are as follows: total length of the "L" side attachment in each direction, 1.25 inches; width of loops 20 and 28, 0.63 inches, inner radius of loop apertures 21 and 29, 0.15 inches; outer radius of apertures 21 and 29, 0.28 inches; depth of recess 25, 0.10 inches; width of recess 25, 0.42 inches; width of aperture 26, 0.18 inches; width of aperture 27, 0.23 inches; angle of aperture 27 is 65.6 degrees; height of loops 20 and 28, 0.56 inches; thickness of strap end 24 is 0.24 inches and thickness of strap end 23 is 0.13 inches. Obviously, these dimensions can be varied in order that the "L" shaped side attachment strap can fit face guards without standard dimensions or guards that are comprised of flattened plastic bars.

Referring again to FIG. 12; recess 25 houses the head of a screw 36 that travels through aperture 26 into a T-nut that originates inside the helmet. Aperture 27 is angled to take into account the curvature of the helmet.

Figure 14:
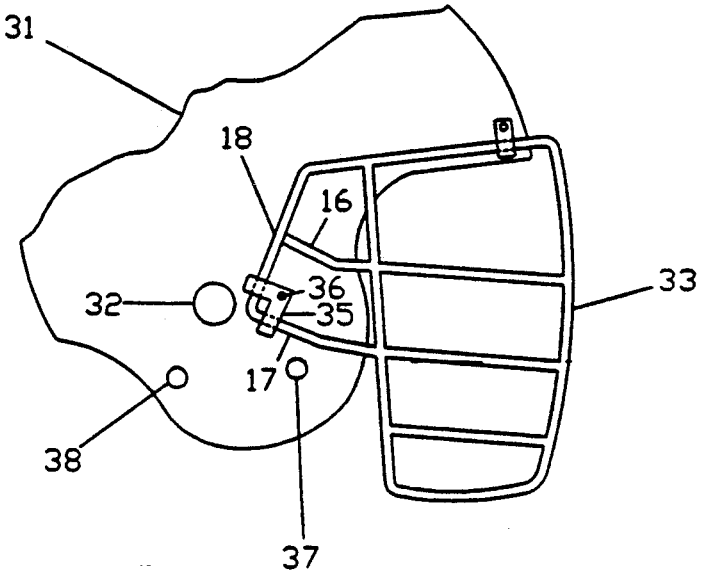
FIG. 14 is a fragmentary perspective view showing the improved "L" side attachment strap securing a single wire guard to a helmet. NOTE: A double wire face guard is secured to the helmet by the improved "L" side attachment strap in the same manner as the single wire guard is.

FIG. 14 is a fragmentary perspective view showing the improved "L" side attachment 35 securing a single wire face guard 33 to a helmet 31. The improved "L" side attachment would fit the same way on the double wire face guard.

Figure 15:
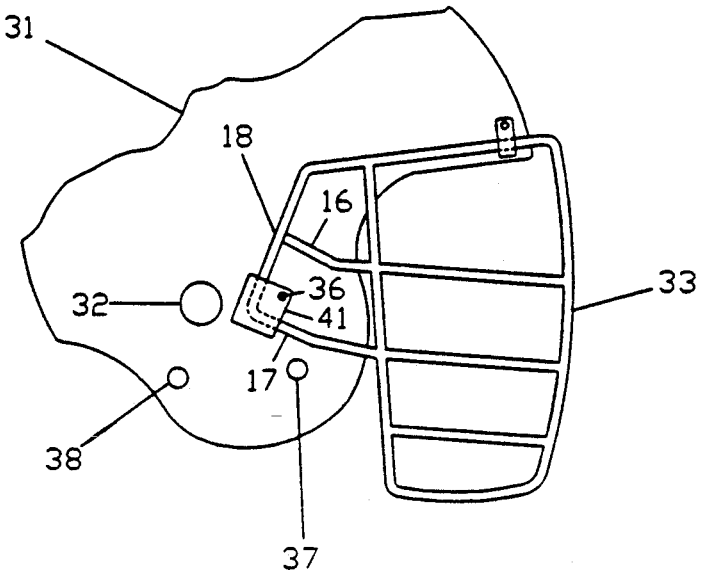
FIG. 15 is an improved solid side attachment. This improved solid side attachment will achieve the same results that the improved "L" side attachment will, except that it would cost move to manufacture.

Referring now to FIG. 15, this is a less economical version of the present invention "L" side attachment strap. This solid side attachment 41 achieves the same results as the present invention "L" side attachment 35 shown in FIG. 14 except that it would cost more to manufacture because it requires more material. This solid side attachment 41 would fit the same way on a double wire guard.

Figure 16:
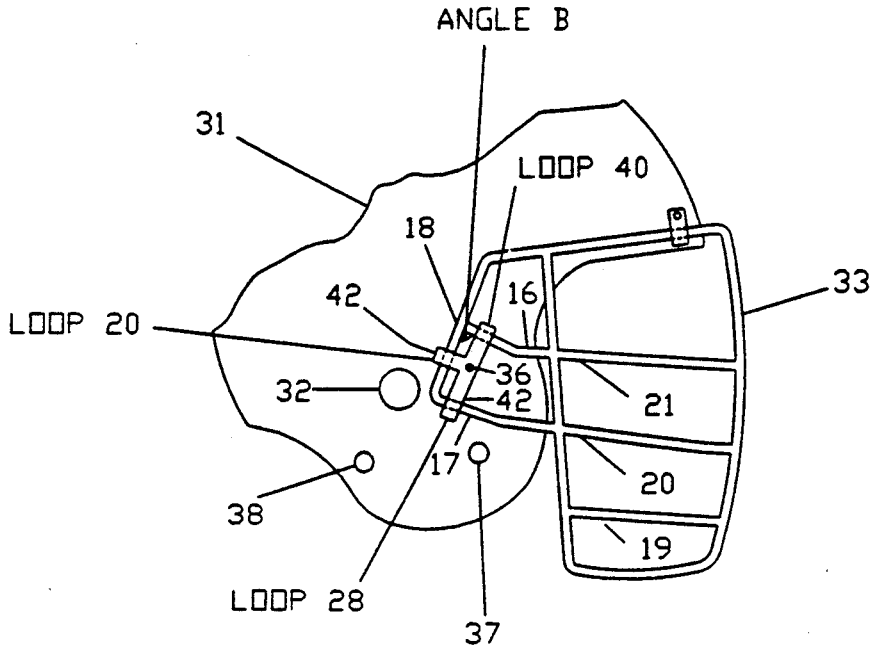
FIG. 16 shows a side view of the improved "T" side attachment strap securing a single wire guard to a helmet.
Figure 17:
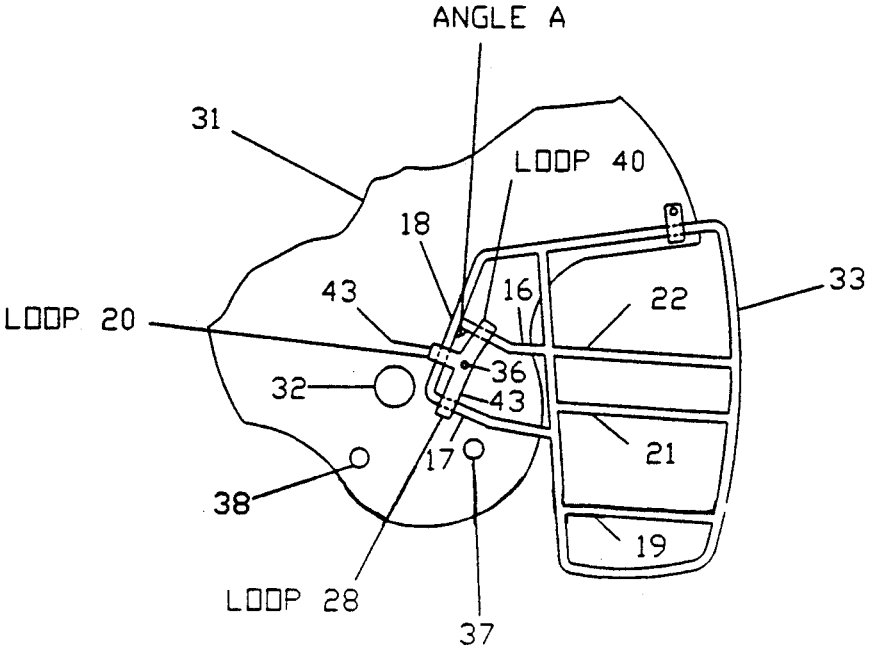
FIG. 17 shows a side view of the improved "T" side attachment securing a double wire face guard to a helmet.

FIGS. 16 and 17 disclose "T" side attachments, 42 and 43 respectively, that would once again achieve the same results as the present invention "L" side attachment, that is restricting bar 18 of the rear section 15 of guard 33 from getting moved through the single loop of the prior art side attachment strap, except that it is once again not as economical because different "T" side attachments, 42 and 43 in FIGS. 16 and 17 respectively, would have to be manufactured for the single and the double wire guard due to the different angles, B and A, of the single and double wire guards. FIG. 16 depicts the "T" side attachment 42 securing a single wire guard to a helmet 31; while, FIG. 17 depicts a "T" side attachment 43 securing a double wire guard to a helmet 31.

Figure 18:
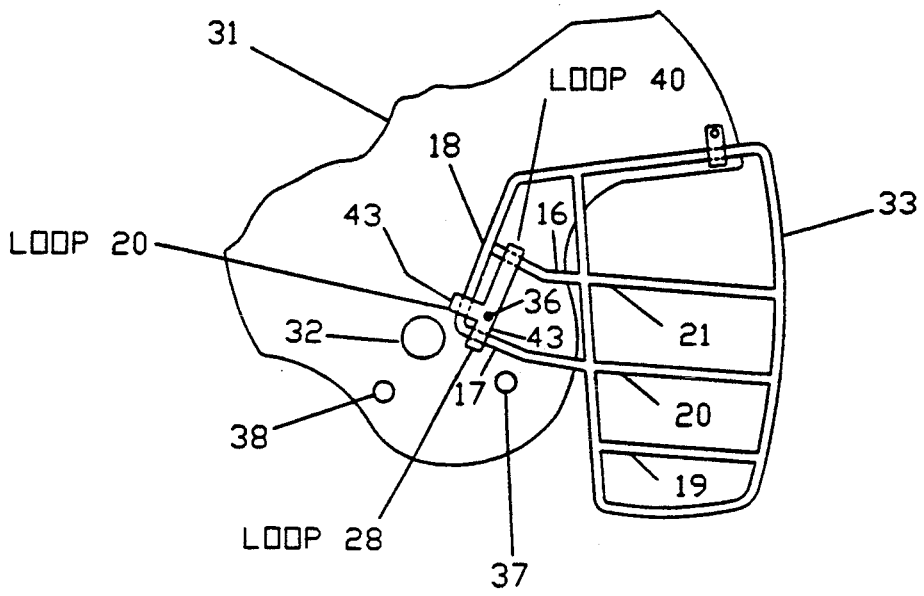
FIG. 18 depicts an improved "T" side attachment that does not have loops that are all equal in length.

FIG. 18 discloses a version of the "T" side attachment 43, where loop 20 of the "T" side attachment 43 that restricts movement in the arc pattern is positioned as close to bar 16 of the rear section 15 of guard 33 as possible causing the "T" shape to be non-symmetric. FIG. 18 depicts the non-symmetric "T" side attachment securing a single wire guard to a helmet. This could also be designed to fit a double wire face guard to accommodate the different angles A and B. Once again, this version would be more expensive to manufacture.

Figure 19:
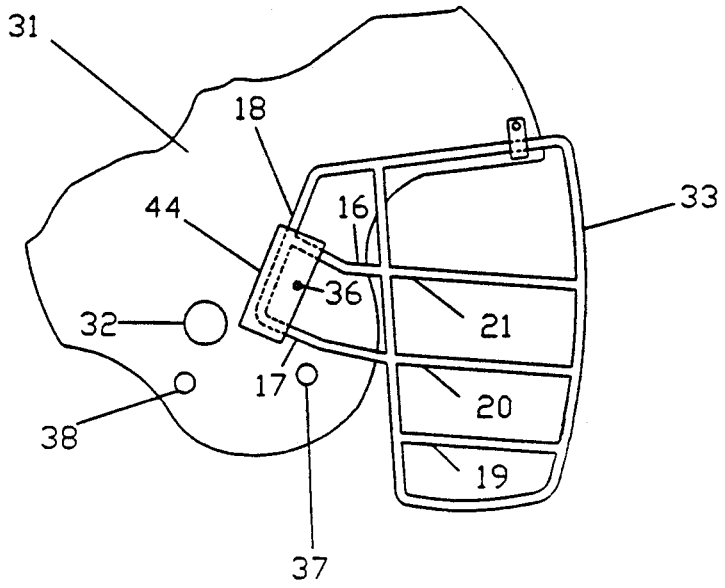
FIG. 19 depicts an improved solid side attachment strap that encircles both horizontal bars of the rear portion of the guard.

FIG. 19 discloses a solid version of the "T" side attachment 44 securing a single wire face guard to a helmet 31. This could also be designed to fit a double wire face guard to accommodate the different angles A and B. This would achieve the desired results of stopping bar 18 of the rear section 15 of guard 33 from moving but it would be uneconomical to produce because it requires extra material to manufacture.

Figure 20:
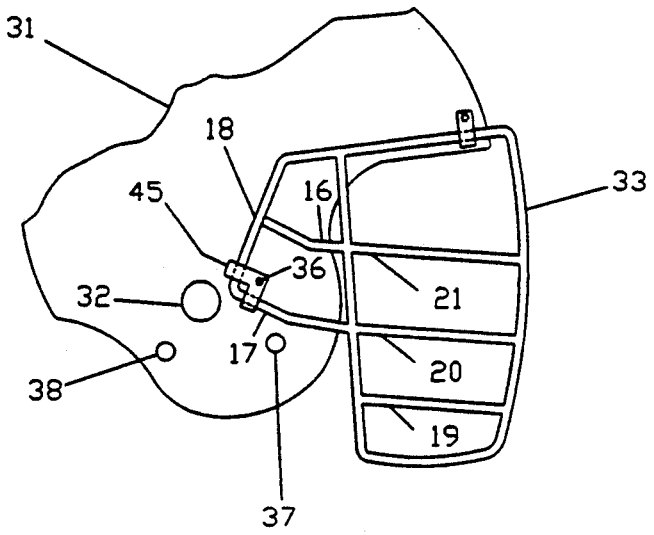
FIG. 20 shows the improved "L" side attachment strap that does not have loops of equal length. This version would require a right and left side attachment strap to be manufactured.

FIG. 20 discloses a version of the present invention "L" side attachment 45 that is not symmetric. That is, loop 20 that encircles bar 18 of the rear section 15 of guard 33 is located as close to bar 17 as possible causing loop 20 to be a different length than loop 28. This would be a slightly more mechanically sound version of the preferred design of the present invention "L" side attachment strap; however, a right and left side side attachment strap would have to be manufactured.

Figure 21:
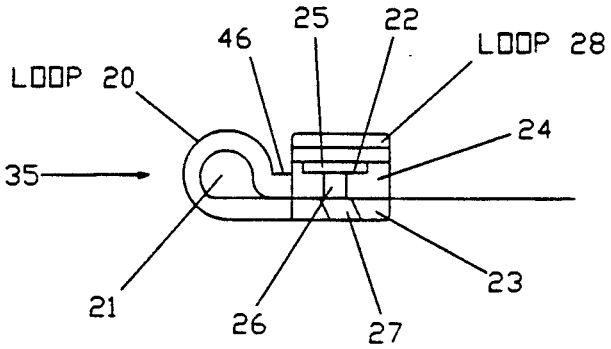
FIG. 21 is a sectional view of the improved "L" side attachment strap that has a neck portion 46.

FIG. 21 discloses a version of the present invention "L" side attachment strap 35 with a neck portion 46 that would improve the shock absorbing properties of the strap. The neck portion 46 gives the present invention "L" side attachment 35 strap improved stretching capabilities.

Figure 22:
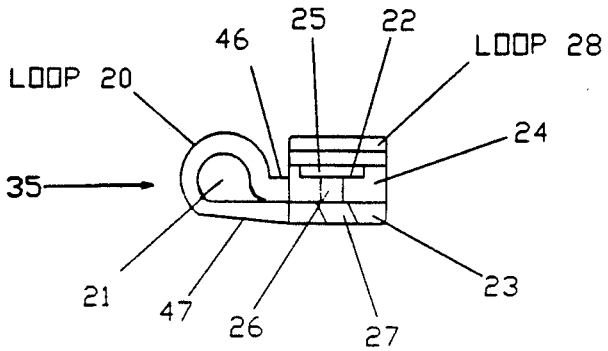
FIG. 22 is a sectional view of the improved "L" side attachment strap that has both a neck portion 46 and a tapered portion 47.

FIG. 22 discloses a version of the present invention "L" side attachment strap 35 that has a tapered strap end portion 47 along with neck portion 46 to give strap flexibility which allows for greater shock absorbing capabilities.

While this invention has been described as having a preferred design, it will be understood that-it is capable of further modification. This application is, therefore, intended to cover any variations, uses, or adaptations of the invention following the general principles thereof and including such departures from the present disclosure as come with known customary practice in the art to which this invention pertains and fall within the limits of the appended claims.

I claim:

1. In a helmet that has a face guard constructed of a series of bars, including bars in the rear section that extend in an inclined vertical direction, and a first front attachment means for attaching the guard to the front of the helmet such that the guard is hinged at the top of the helmet and can swing in the fore and aft directions, the improvement comprising: a unitary positively restricting side attachment means connected to a helmet at at least a common attachment point on at least one side of the helmet, said side attachment means having at least two portions which engage the face guard along two separate areas thereof, to positively restrict face guard movement to a significant degree in the fore and aft directions and in the inclined vertical direction, wherein respective axes of at least some of said at least two portions are non-parallel.

2. The helmet according to claim 1 wherein the unitary side attachment means comprises two loops, each loop having an aperture with a longitudinal axis, where the axes of the loops are non-parallel.

3. The helmet of claim 2 wherein the direction of the axes of the loops are essentially in the inclined vertical direction and the fore and aft directions.

4. A helmet according to claim 2 wherein the unitary side attachment means further comprises a third loop for also attaching to the guard.

5. A helmet according to claim 2 with the area between the two loops filled with material.

6. A helmet according to claim 4 where the area between all three loops is filled with material.

7. A helmet according to claim 2 wherein the unitary side attachment means further comprises two strap end portions where the two loops come together, both strap end sections having apertures, with one of the strap end sections also containing a recess for recessively housing a screw.

8. A unitary side attachment strap for use in a helmet comprising: two loops, each having a loop aperture with a longitudinal axis where the longitudinal axes are non-parallel, having strap end portions with the strap end portions merging together to form a center portion with a first strap end portion having an aperture and a second strap end portion having an aperture and a recess in which the two apertures are aligned such that a screw can be fit through both apertures and the head of a screw can be submerged in the recess of the second strap end portion.

9. The unitary side attachment strap of claim 8 wherein the longitudinal axis in the first strap end is at an angle compared to the longitudinal axis in the second strap end.

10. The unitary side attachment strap of claim 8 where the angle between the longitudinal axes of the apertures of the two loops is approximately between 65 and 115 degrees.

11. The unitary side attachment strap of claim 10, wherein the loop apertures have an inner radius and an outer radius wherein the inner radius is approximately between 1.00 and 0.05 inches and the outer radius is between 1.15 and 0.15 inches respectively and where the length L of the side attachment strap is approximately between 0.50. and 2.0 inches.

12. The unitary side attachment strap of claim 11, wherein the longitudinal axis in the first strap end is at an angle compared to the longitudinal axis in the second strap end.

* * * * *